United States Patent [19]

Yatsuzuka

[11] Patent Number: 4,811,396

[45] Date of Patent: Mar. 7, 1989

[54] SPEECH CODING SYSTEM

[75] Inventor: Yohtaro Yatsuzuka, Tokyo, Japan

[73] Assignee: Kokusai Denshin Denwa Co., Ltd., Tokyo, Japan

[21] Appl. No.: 675,794

[22] Filed: Nov. 28, 1984

[30] Foreign Application Priority Data

Nov. 28, 1983 [JP] Japan ..... 58-22385

[51] Int. Cl.[4] ..... G10L 3/02

[52] U.S. Cl. ..... 381/30; 381/38; 381/47

[58] Field of Search ..... 381/29–40, 381/46, 47

[56] References Cited

U.S. PATENT DOCUMENTS

| | | | |
|---|---|---|---|
| 3,715,512 | 2/1973 | Kelly | 381/30 |
| 3,973,081 | 8/1976 | Hutchins | 381/30 |
| 4,133,976 | 1/1979 | Atal et al. | 381/47 |
| 4,475,227 | 10/1984 | Belfield | 381/30 |
| 4,677,671 | 6/1987 | Galand et al. | 381/31 |

OTHER PUBLICATIONS

Y. Yatsuzuka et al., "Application of 32 and 16 kb/s Speech Encoding Techniques to Digital satellite Communications", International Journal of Satellite Communication, vol. 1 (1983) pp. 113–114.

Study on Voice Coding Techniques applicable to the Inmarsat system, Oct. 1982, Kokusai Denshin Denwa Co. Ltd. (Research & Development Denwa Co. Ltd).

*Primary Examiner*—Emanuel S. Kemeny
*Assistant Examiner*—David D. Knepper
*Attorney, Agent, or Firm*—Armstrong, Nikaido, Marmelstein & Kubovcik

[57] ABSTRACT

A speech signal coding system comprises a prediction filter coupled with an output of a quantizer for prediction of a signal. A subtractor provides the difference between an input signal and an output of the prediction filter. A quantizer quantizes the residual signal, which is the difference provided by the subtractor. The quantizer is improved by adaptively adjusting step size for quantization. Thus, the coded outputs, according to the present invention, are the parameter information of the prediction filter, quantized output of the residual signal, and step information for quantization. The quantization step is determined according to the fundamental step size which provides the statistical variance, equal to one, to the quantized signal, and/or the power of the residual signal. Because of an efficient encoding with an adaptive control of the quantization step, the bandwidth for transmission of the coded signal in a communication system or transmission rate of coded speech signal is minimized. Excellent speech is reproduced through a narrow band channel, or low bit rate digital channel like 16 kbits/second digital channel.

7 Claims, 7 Drawing Sheets

SPEECH CODING SYSTEM

BACKGROUND OF THE INVENTION

This invention relates to a speech coding system and, in particular, relates to a speech coding system which is suitable for use in communication systems on which a severe limitation is imposed on the frequency band and the transmitting power.

In communication systems on which these limitations are imposed, such as digital maritime satellite communication systems or SCPC, a speech coding system is required such that the coded speech signal of high performance and low bit rate can be obtained. Speech quality of the reproduced speech is high in spite of the presence of transmission code errors.

In view of this technical background, 16 kb/s adaptive predictive coding (APC) of speech signal has been proposed.

FIG. 1 shows one example of the prior APC systems, referred to as pre-emphasis/de-emphasis method. This system is so designed that the power of the quantization noise is kept low in a relatively high frequency voiceband, when compared with the power of the speech signal. Thus, the hiss noise is reduced and the speech quality in the reproduced speech is improved.

In FIG. 1, a digital voiceband signal, or successive speech samples are provided to a coder input terminal 1 through an analog bandpass filter and an analog-digital converter (both of them not shown). A pre-emphasis circuit 2 emphasizes the power of the signal components with relatively high frequency. A spectrum analyzer 3 analyzes the spectrum of the signal from the pre-emphasis circuit 2 at every frame whose duration is equal to 20 ms for example, and then calculates predictor coefficients for a short-term spectrum predictor 4 denoted by P(z). The short-term predictor 4, with the predictor coefficients, calculates a prediction value for the current sample of the speech signal. A subtractor 5 provides a residual error signal by calculating the difference between the prediction value and the current sample. Then, an adaptive quantizer 6 quantizes the residual signal. An adaptive inverse quantizer 7 inversely quantizes the quantized residual signal. An adder 8 adds the reconstructed residual signal provided by the inverse quantizer 7 to the prediction value. The output of the adder 8 is provided to the short-term predictor 4, which calculates the next prediction value. The quantized residual signal from the quantizer 6 and the predictor coefficients from the spectrum analyzer 3 are coded and then multiplexed by a multiplexer 9. The multiplexed signal is transmitted to a decoder through a coder output terminal 10.

The transmitted signal is input at input terminal 11 and demultiplexed by demultiplexer into the quantized residual signal and the predictor coefficients. The quantized residual signal is inversely quantized by an adaptive inverse quantizer 13, which provides the reconstructed residual signal to one of the inputs of an adder 15. On the other hand the, predictor coefficients are provided to a short-term spectrum predictor 14 denoted by P(z). It calculates a prediction value for the present sample based on the past reconstructed samples. The adder 15 adds the prediction value to the current sample. The output of the adder 15 is provided to the input of the predictor 14 to calculate the prediction value for the next sample. The output of the adder 15 is also provided to a de-emphasis circuit 16, which provides a decoded speech signal to a decoder output terminal 18. This speech signal is then reproduced through a digital-analog converter and an analog bandpass filter (both of them not shown). As shown in FIG. 1, the pre-emphasis circuit 2 consists of a digital filter 2' denoted by G(z) and a subtractor 2''. The de-emphasis circuit 16 consists of a digital filter 16' denoted by G(z) and an adder 16''.

In this prior coding system, the use of the pre-emphasis circuit 2 and the de-emphasis circuit 16 makes it possible to improve speech quality in the reproduced speech. In other words, the quantization noise component in relatively high frequency band is kept low, and thus the hiss noise in such a frequency band is reduced.

However, this prior system has the disadvantage that the characteristics of the pre-emphasis and the de-emphasis circuits 2 and 16 are not always adaptive to the properties of the speech signal because the digital filters 2' and 16' use the fixed predictor coefficients.

FIG. 2 shows an another prior speech coding system. The feature of this prior system is the use of a noise shaping filter 22 which is so designed that the spectrum of the quantization noise which is approximately white is adaptively shaped so as to correspond to the spectrum of the input speech signal.

In this figure, at the output of the subtractor 5, there is provided the residual signal. A subtractor 23 provides a final residual signal by calculating the difference between the residual signal and the output of the noise shaping filter 22 denoted by P(z). The final residual signal is quantized by the adaptive quantizer 6. The quantized final residual signal is inversely quantized by the adaptive inverse quantizer 7, which provides a reconstructed final residual signal. Then, a quantization noise is provided by calculating the difference between the constructed final residual signal and the final residual signal from the subtractor 23. The quantization noise is then provided to the noise shaping filter 22.

The noise shaping filter 22 consists of digital filters and its transfer function can be expressed in the Z-transform notation as $$F(z) = \sum_{i=1}^{N} a_i r^i z^{-i}$$

where F(z) is the frequency response of the noise shaping filter, N is the tap number of the filter 22, $a_i$ is a predictor coefficient of i-th tap and r is a constant in the region of 0 to 1. The value r is selected so that speech quality in the reproduced speech is improved.

However, the prior speech coding system of FIG. 2 has the following disadvantages.

(1) The prepared quantization characteristics of the adaptive quantizer 6 is not perfectly suitable for the properties of the final residual signal such as the amplitude distribution and/or the power, because the output of the noise shaping filter 22 is returned to the input of the adaptive quantizer 6. In other words, it is impossible to prepare the quantization characteristics suitable for the properties of the final residual signal. Thus, the quantization noise increases.

(2) The combination of the adder 15 and the short-term predictor 14 forms a recursive digital filter. It should be noted that the output of the adder 15 is returned to the input of the predictor 14. On the other hand, the predictor coefficients to be set in the predictor 14 are the optimum coefficients to predict the present value of the residual signal from the inverse quantizer 13. Thus, when the transmitted signal has the transmission code error due to, for example, fading, the recursive filter is apt to oscillate, or sometimes oscillates. Therefore, speech quality in the reproduced speech deteriorates considerably.

SUMMARY OF THE INVENTION

It is an object, therefore, of the present invention to overcome the disadvantages of the prior speech coding systems by a new and improved speech coding system.

It is also an object of the present invention to provide a speech coding system which provides the coded speech signal with high performance and low bit rate.

The present speech coding system comprises at least a prediction device for predicting prediction values for an input speech signal and providing a residual signal corresponding to the difference between the prediction value and the input speech signal, a quantizing device for quantizing a final residual signal based upon a quantization step size to be adjusted and then for delivering a coded final residual signal, an inversely quantizing device for inversely quantizing the coded final residual signal to obtain a reconstructed final residual signal, a noise shaping device for extracting a quantization noise between the reconstructed final residual signal and the final residual signal, for shaping the spectrum of the quantization noise and for returning the spectrum-shaped quantization noise to the input of the quantizing means to obtain the final residual signal corresponding to the difference between the residual signal and the spectrum-shaped quantization noise, and a quantization step size adjusting device for providing the quantization step size of the quantizing means based on properties of the input speech signal.

BRIEF DESCRIPTION OF THE DRAWINGS

The foregoing and other objects, features, and attendant advantages of the present invention will be appreciated by means of the following description and accompanying drawings wherein.

DESCRIPTION OF THE PREFERRED EMBODIMENTS

Figures 1, 3A:
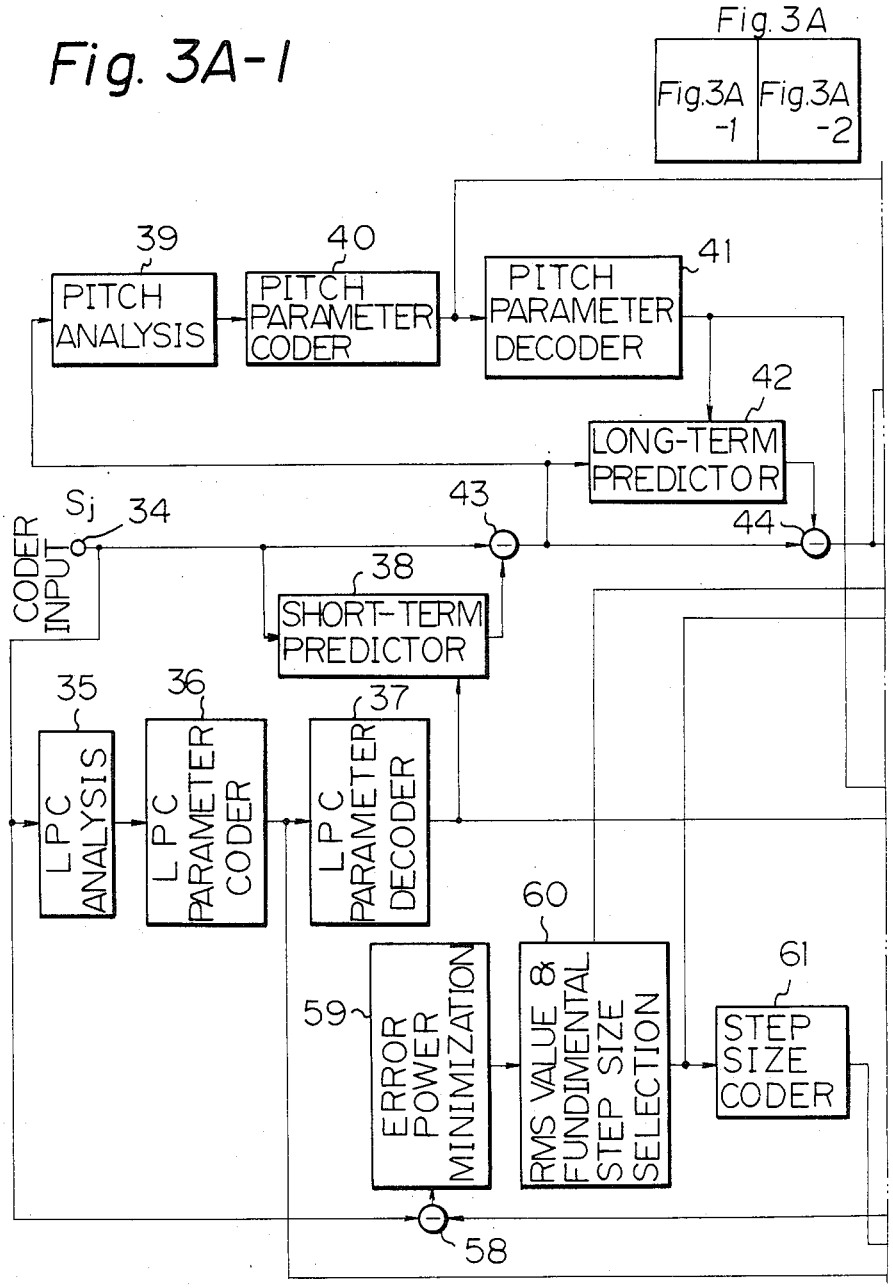
FIG. 3A is a block diagram of a coder of the first embodiment according to the present invention.
Figures 2, 3A:
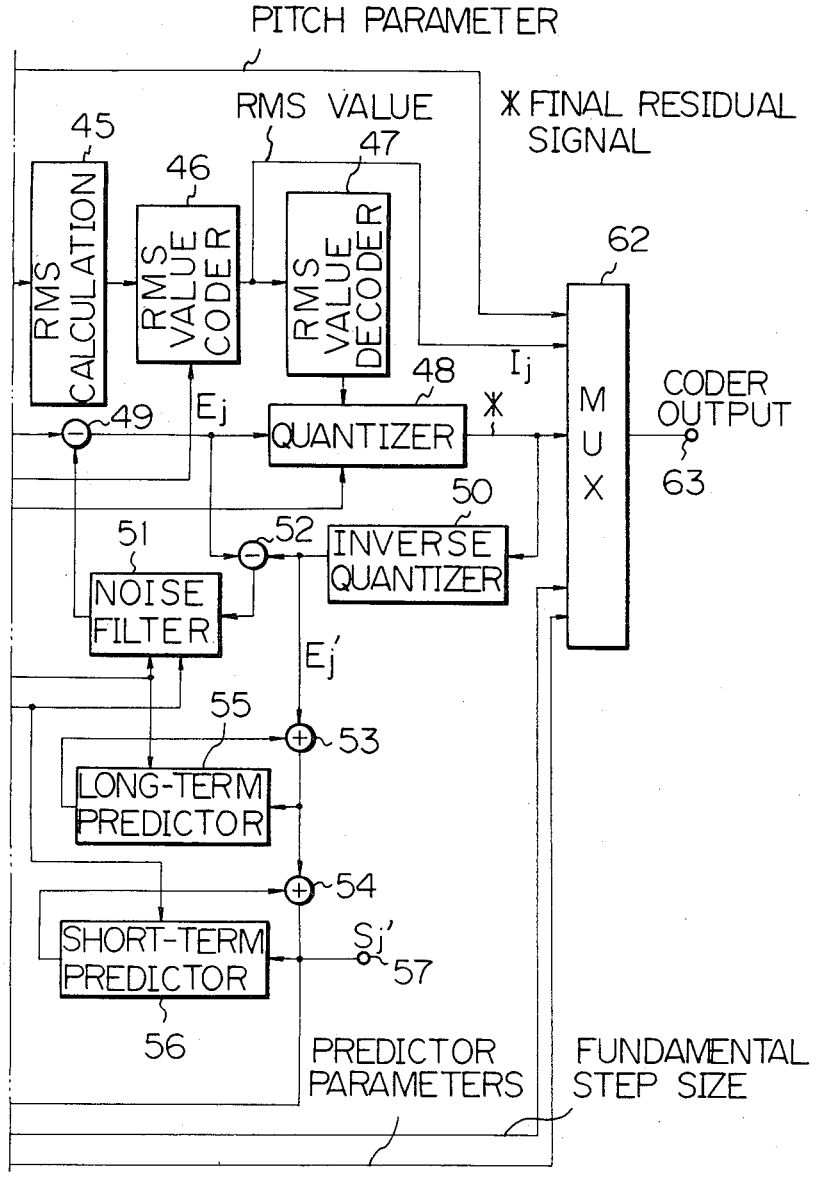

FIG. 3A is a block diagram of a coder of the first embodiment according to the present invention.

The coding according to the present coder is done in four fundamental stages:

(a) Short-term prediction based on short-time spectral envelope corresponding to correlations between successive speech samples, (b) Long-term prediction based on the quasi-periodic nature of voiced speech excited by pitch pulse, (c) Adaptively filtering a quantization noise and subtracting the quantization noise filtered from a residual signal provided by short-term and long-term prediction, and (d) Quantizing a final residual signal provided through the stage (c) based on quantization parameters which is adjusted at every subframe so as to minimize the power of an error signal defined as the difference between a locally decoded speech signal and the input speech signal.

The features of the present embodiment exist in the stages (a) and (d).

The description will be now given of the coder according to the stages (a) through (d).

Stage (a)

Figure 2:
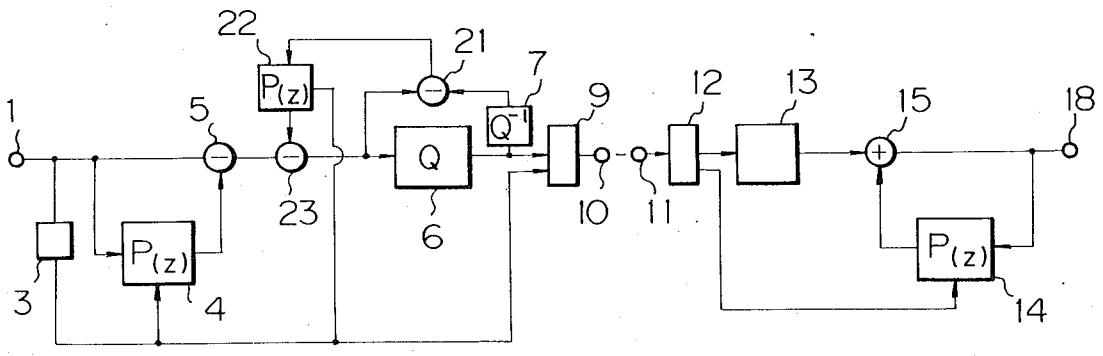
Fig. 2 PRIOR ART
FIG.2 is a block diagram of an another prior adaptive predictive coding system equipped with the noise shaping filter.

In fig.3(A), successive input samples $S_j$ at a coder input terminal 34 is provided to a LPC analyzer 35, which calculates LPC parameters from the successive input samples in every frame. In the LPC analyzer 35, LPC parameters are extracted by an auto correlation method at every frame. The extracted LPC parameters are coded by a LPC parameter coder 36. The coded LPC parameters are then decoded by a LPC parameter decoder 37 to calculate the predictor coefficients ($\alpha_1$, $\alpha_2$, ---, $\alpha_N$) for a short-term spectrum predictor 38. The number of taps of N in the short-term predictor is conventionally around 4 to 12. The coded LPC parameters are also transmitted to a decoder shown in FIG. 3A-2 through a multiplexer 62.

In the short-term predictor 38, each of the predictor coefficients ($\alpha_1$, $\alpha_2$, ---, $\alpha_N$) is weighted. That is to say, the short-term predictor 38 consisting of digital filters can be expressed in the Z-transform notation as $$P_1(z) = \sum_{i=1}^{N} a_i Z^i$$

and weighted predictor coefficients ($a_1$, $a_2$, ---, $a_N$) are $$a_i = \alpha_i \beta^i$$

where N is the number of taps of the predictor 38, $a_i$ is weighted predictor coefficient of i-th tap, and $\beta$ is a definite constant in the range of 0 to 1 such as 0.99. The use of definite constant makes it possible to reduce the perceptual noise in the reproduced speech, which results from the transmission error. The predictor coefficients ($\alpha_1$, $\alpha_2$, ---, $\alpha_N$) are provided to a noise shaping filter 51 and a short-term spectrum predictor 56 for local decoding. In the noise shaping filter 51 and the short-term predictor 56, the weighted predictor coefficients ($a_1$, $a_2$, ---, $a_N$) are used, which are derived from the predictor coefficients ($\alpha_1$, $\alpha_2$, ---, $\alpha_N$).

The short-term predictor 38, with the weighted predictor coefficients ($a_1$, $a_2$, ---, $a_N$), calculates a prediction value for the current sample of the input speech signal based on the previous N successive samples. The current sample is then subtracted by the prediction value by a subtractor 43, which provides a short-term prediction error. Similarly, all the samples in the common frame are predicted using the same predictor coefficients and then the prediction errors are obtained at each sample. Thus, a short-term spectral residual signal in which the correlation on the short-term of the input speech signal has been removed is obtained at the output of the subtractor 43.

Stage (b)

The short-term residual signal is supplied to, on the one hand, a pitch analyzer 39, which calculates pitch parameters consisting of a pitch period $N_p$ and predictor coefficients for a long-term spectrum predictor 42. The pitch parameters are coded by a pitch parameter coder 40. The coded pitch parameters are provided to the decoder through the multiplexer 62 to the coder output 63 and also to a pitch parameter decoder 41, which decodes the coded pitch parameters. The decoded pitch parameters are supplied to the long-term predictor 42, the noise shaping filter 51 and a long-term spectrum predictor 55 for local decoding.

Using the pitch period $N_p$, the predictor coefficients and the short-term residual signal from the subtractor 43, the long-term predictor 42 calculates a prediction value for the present value of a periodic signal with pitch exitation, based on that adjacent pitch periods in voiced speech show considerable similarity. That is to say, the long-term predictor with a first order for example, can be characterized in the Z-transform notation by $$P_z(z)=a_pA^{-Np}$$

where $a_p$ is a predictor coefficient. The pitch period $N_p$ represents a relatively long delay in the range of 2 to 20 ms.

The present value is then subtracted from the prediction value by a subtractor 44.

Thus, at the output of the subtractor 44, there is obtained a residual signal in which the redundancy in the waveform of the input speech signal on the short-term and the long-term has been removed. That is, the residual signal is ideally made white.

Stage (c)

A spectrum of a quantization noise provided at the output of a subtractor 52 is adaptively shaped by the noise shaping filter in the similar way as the prior noise filter 22. A subtractor 49 provides a final residual signal $E_j$ by subtracting the difference between the output of the subtractor 52 applied to noise filter 51 and the residual signal from the subtractor 44.

Stage (d)

The final residual signal is quantized by an adaptive quantizer 48. In quantizing, according to the present embodiment, a quantization step size is set at every subframe whose length is equal to for instance ¼ of one frame length. In detail, the optimum step size to quantize the final residual signal is adjusted at every subframe so as to minimize the power of an error signal provided by subtracting the input speech signal and a locally decoded speech signal. Necessity of adjusting the quantization step size results from the fact that the characteristics of the final residual signal such as its amplitude distribution or its power always varies with time, because the shaped noise signal is returned to the input of the quantizer 48. Thus, the present embodiment makes the quantization step size to be set in the quantizer 48 vary corresponding to the variance of the characteristics of the final residual signal.

In order to adjust the quantization step size, in this embodiment several fundamental step sizes and several RMS values for the final residual signal are prepared. The quantization step size is defined by the combination of one of fundamental step sizes and one of RMS values. Therefore, the optimum step size for quantizing the final residual signal is obtained by selecting, at every subframe, a combination permitting the power of the error signal between the input speech signal and the locally decoded speech signal to be minimized.

A fundamental step size is defined as the step size capable of minimizing the quantization error when the variance of the final residual signal is equal to 1. In the quantizer 48, there are stored several fundamental step sizes, taking into account the characteristics of the final residual signal. For example, the first fundamental step size is suitable for quantizing the final residual signal with Gaussian distribution whose variance is equal to 1, the second fundamental step size with Laplacian distribution whose variance is equal to 1, and so on.

On the other hand, when the variance of the final signal is not equal to 1, in other words, when its normalized power is not equal to 1, the fundamental step size is unsuitable for quantizing such a signal. That is, provided that the fundamental step size is set in the quantizer 48, its quantization characteristics would deteriorate. Thus, in order to compensate for this deterioration and obtain the optimum step size, several RMS values are prepared based upon the calculated RMS value of the residual signal from the subtractor 44. Each of RMS values indicates the degree of the variance or the normalized power to be set in the quantizer 48.

A description will be now given of the adjusting method of the quantization step size of the adaptive quantizer 48.

A RMS value calculation circuit 45 calculates the RMS value of the residual signal which is white. The calculated RMS value is coded by a RMS value coder 46, and then the coded RMS value is stored as a primary value therein. At this time, several values close to the primary level are calculated and then stored in the RMS value coder 46.

First, the coded RMS value corresponding to a primary value is decoded by a RMS value decoder 47 and then supplied to the quantizer 48 as a primary RMS value. The quantizer 48 selects one of the fundamental step sizes corresponding to Gaussian distribution for example, and then multiples the selected value to the primay RMS value. Thus, the first step size is set in the quantizer 48. The, the quantizer 48 quantizes the final residual signal $E_j$ with the first step size and codes a quantized final residual signal. The output $I_j$ of the quantizer 48 is inversely quantized by an adaptive inverse quantizer 50, which provides a reconstructed final residual signal $E'_j$. A subtractor 52 calculates a quantization noise between the signals $E'_j$ and $E_j$. The noise shaping filter 51 shapes the spectrum of the quantization noise adaptively as described in the stage (c).

On the other hand, the final residual signal $E_j$ from the inverse quantizer 50 is added by an adder 53 to an output of the long-term predictor 55 for local decoding in which the pitch parameters from the pitch parameter decoder 41 are set. The output of the adder 53 is supplied to an input of the long-term predictor 55 and to one of inputs of an adder 54. Its output is added to an output of the short-term predictor 56 for local decoding in which the LPC parameters from the LPC parameter decoder 37 are set. The output of the adder 54 is supplied to the input of the short-term predictor 56. Thus, at a locally decoded speech signal terminal 57, there is obtained a locally decoded speech signal $S'_j$. A subtractor 58 calculates a difference signal between the input speech signal $S_j$ from the coder input terminal 34 and the locally decoded speech signal $S'_j$, and then provides it as an error signal to a minimum error power detector 59. The detector 59 calculates the error power of the error signal and then stores it therein. Thus, in the detector 59 there is obtained the error power corresponding to the combination of the primary RMS value and the fundamental step size for Gaussian distribution.

Then, in the similar way as the first step size, the quantization step sizes provided by the combinations of the primary RMS value and each of the other prepared fundamental step sizes are calculated, respectively, and then the error powers corresponding to the respective step sizes are calculated and stored in the minimum error power detector 59.

Further, the quantization step sizes provided by the combinations of each of the RMS values close to the primary RMS values and each of all fundamental step sizes are calculated, respectively, and then the error powers corresponding to the respective step sizes are calculated and stored in the detector 59.

The minimum error power detector 59 detects the minimum error power among all the error powers stored therein. Then, a RMS value and a fundamental step size selector 60 selects the combination of the RMS value and the fundamental step size, corresponding to the detected minimum error power. The selected RMS value is supplied to the adaptive quantizer 48 through the RMS value coder 46 and the RMS value decoder 47. Further, the selected RMS value is transmitted through the RMS value coder 46 and the multiplexer 62. On the other hand, the selected fundamental step size is supplied to the quantizer 48 and a fundamental step size coder 61. The latter codes the selected fundamental step size, which is transmitted to the decoder through the multiplexer 62 and coder output 63. The adaptive quantizer 48 quantizes the final residual signal $E_j$ with the selected RMS value and the selected fundamental step size. The quantized final residual signal is then coded and the coded final residual signal $I_j$ is transmitted to the decoder through the multiplexer 62.

Thus, as a result of coding, the following coded information is multiplexed by the multiplexer 62 and then transmitted to the decoder.

the predictor coefficients ($\alpha_1$, $\alpha_2$, ---, $\alpha_N$)
the pitch parameters ($N_p$, $a_p$)
the selected fundamental step size
the selected RMS value
the final residual signal ($I_j$)

Figure 3B:
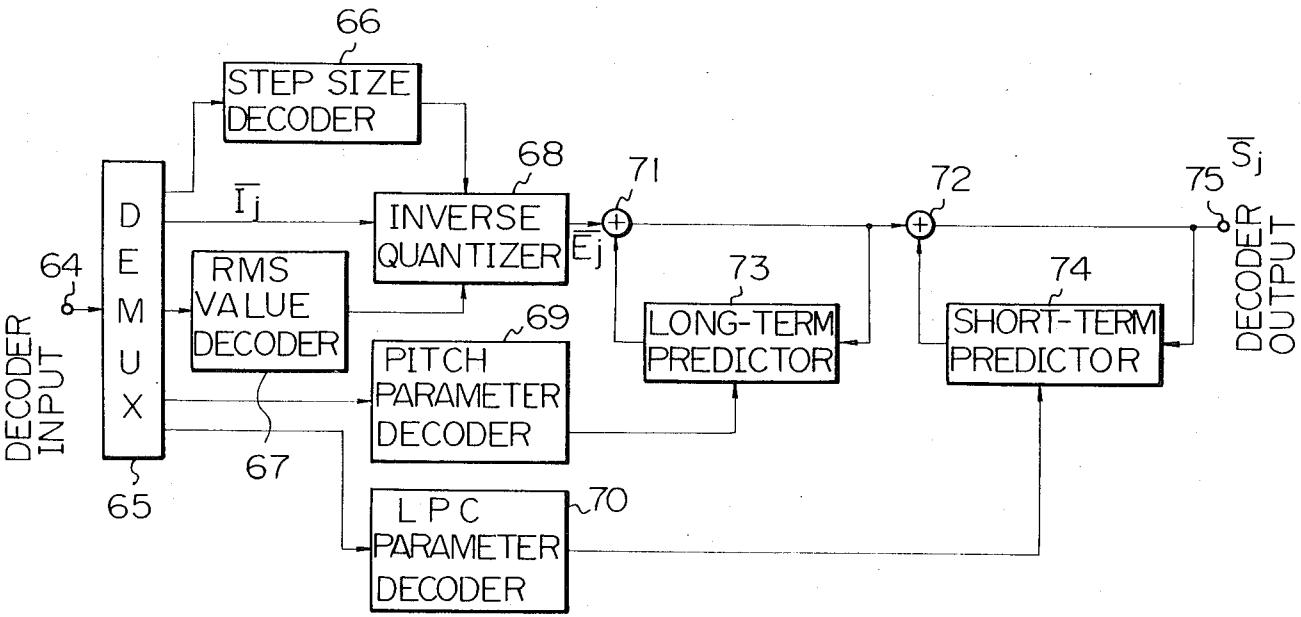
FIG. 3B is a block diagram of a decoder for decoding the signal transmitted by the coder of fig.3A, and FIGS. 4A and 4B are a block diagram of a coder of the second embodiment according to the present invention.

The description will be now given of a decoder shown in FIG. 3B.

The present decoder may operate in the similar way as the prior decoding. The multiplexed signal is received through a decoder input terminal 64 to a demultiplexer 65, which demultiplexers the received signal into the above five signals.

The coded RMS value is decoded by a RMS value decoder 67. The coded fundamental step size is decoded by a fundamental step size decoder 66. The respective outputs of the decoder 66 and 67 are supplied to an adaptive inverse quantizer 68. Thus, the selected RMS value and the selected fundamental step size are set in the inverse quantizer 68. The inverse quantizer 68 then inversely quantizes the quantized final residual signal $\bar{I}_j$ and provides the reconstructed final residual signal $\bar{E}_j$.

On the other hand, the coded predictor coefficients from the LPC parameter coder 36 is decoded by a LPC parameter decoder 70 and then the predictor coefficients ($\alpha_1$, $\alpha_2$, ---, $\alpha_N$) are set in a short-term spectrum predictor 74 with the weight. Further, the coded pitch parameters from the pitch parameter coder 40 is decoded by a pitch parameter decoder 69, and then the pitch period $N_p$ and the predictor coefficients $a_p$ are set in a long-term spectrum predictor 73.

The long-term predictor 73 predicts a prediction value for the present sample based on the previous pitch and then provides it to one of two inputs of an adder 71. The final residual signal provided to the other input of the adder 71 is added to the prediction value by the adder 71, the output of which is supplied to one of two inputs of an adder 72.

The short-term predictor 74 predicts a prediction value for the current sample based on the past reconstructed value of the output signal of the adder 72, and then provides it to the other input of the adder 72. Thus, at a decoder output terminal 75 there is provided the decoded speech signal $\bar{S}_j$.

The decoded speech signal is then reproduced by a digital-analog convertor and a analog voiceband filter (both of them not shown).

According to the present speech coding system, the following advantages can be obtained.

(1) The adaptive quantizer 48 always has the optimum quantization characteristics to minimize the quantization error, because the quantization step size is adjusted at every subframe so as to minimize the error power of the error signal between the input speech signal $S_j$ and the locally decoded speech signal $S'_j$. Thus, speech quality in the reproduced speech signal is effectively improved. This effect has been confirmed with the simulation of 16 kb/s bit rate.

(2) The operation of the decoder is kept very stable in spite of the presence of the transmission error, because the predictor coefficients ($\alpha_1$, $\alpha_2$, ---, $\alpha_N$) for the short-term predictor 38, 74 are weighted with $\beta(0<\beta<1)$ in such a way that the gain of the short-term predictors 38, 74 is somewhat reduced. That is, even if the coded final residual speech signal $\bar{I}_j$ at the receiving side has a noise due to the transmission error, the recursive filter consisting of the short-term predictor 74 and the adder 72 does not oscillate. The simulation of 16 kb/s coding bit rate with respect to the transmission error with $10^{-3}$ error probability shows that the deterioration of speech quality in the reproduced speech is not perspectible. Therefore, the present coding system is suitable for use in the systems such that the transmission error due to fading is equal to $10^{-3}$ or worse, for instance maritime satellite communication systems.

As a modification of the present embodiment, either one of the fundamental step size or the RMS value may be fixed, and only the other one may be adjusted. Further, the quantization step size may be adjusted at every frame, instead of every subframe.

Figure 1:
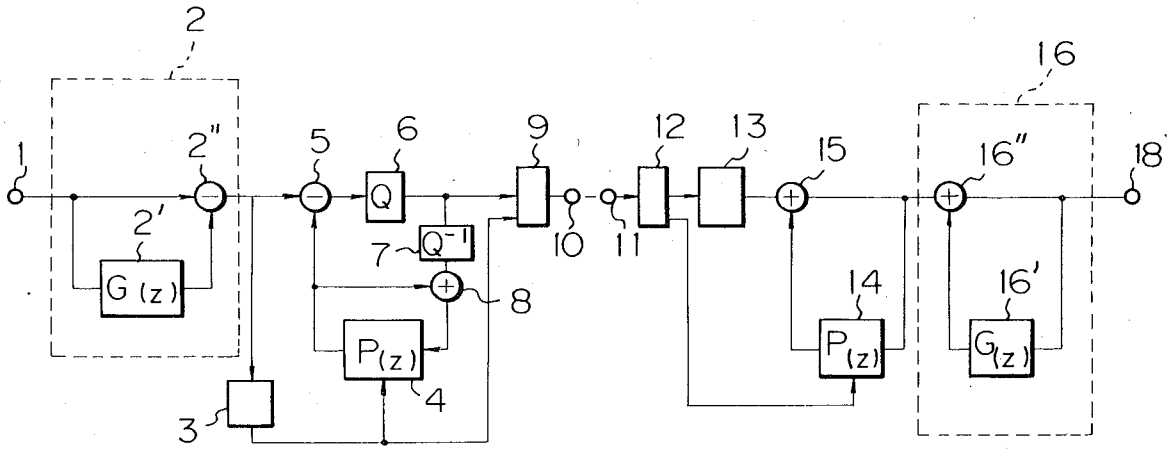
Fig. 1 PRIOR ART
FIG.1 is a block diagram of a prior adaptive predictive coding system using pre-emphasis/de-emphasis.
Figure 4A:
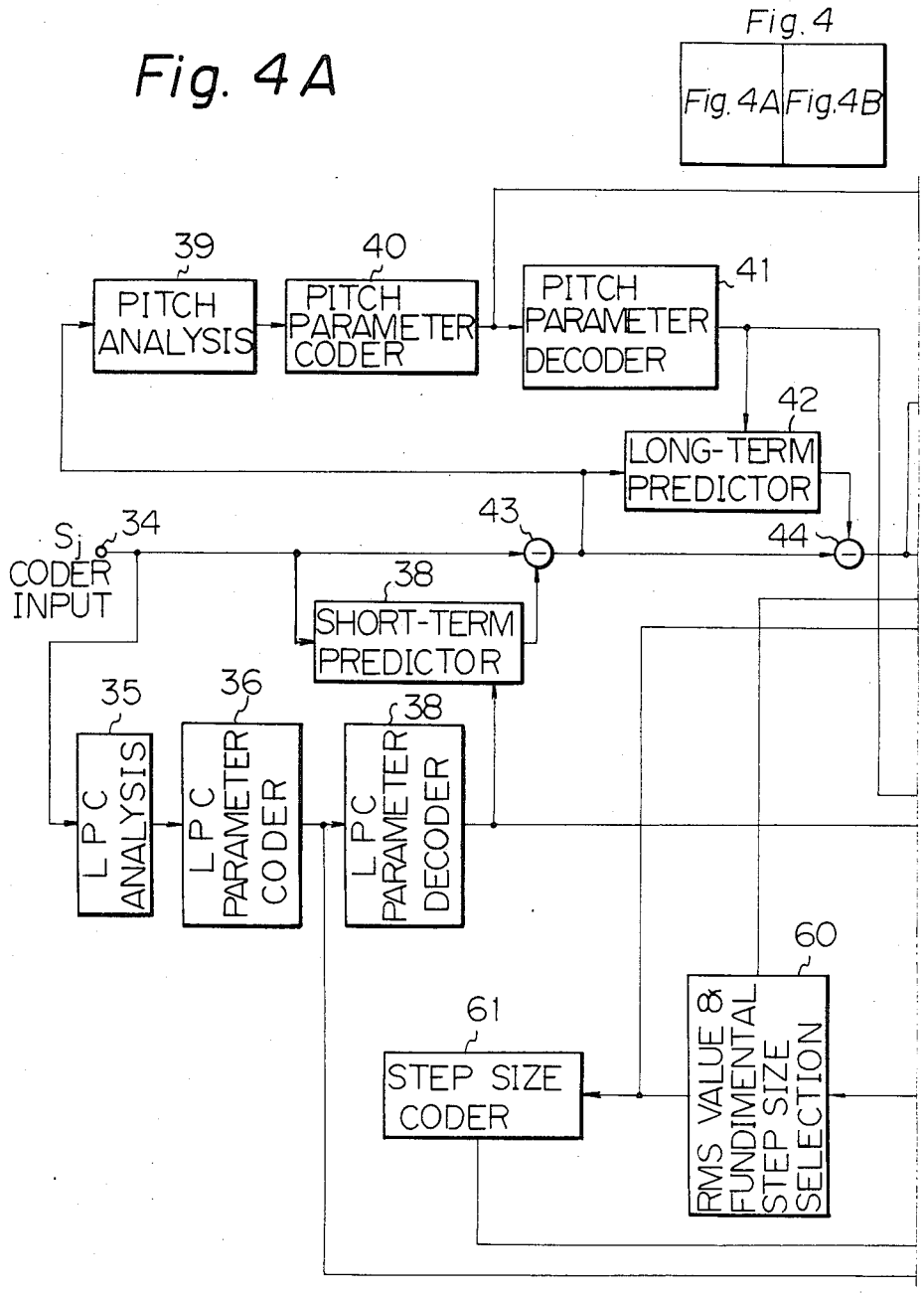
Figure 4B:
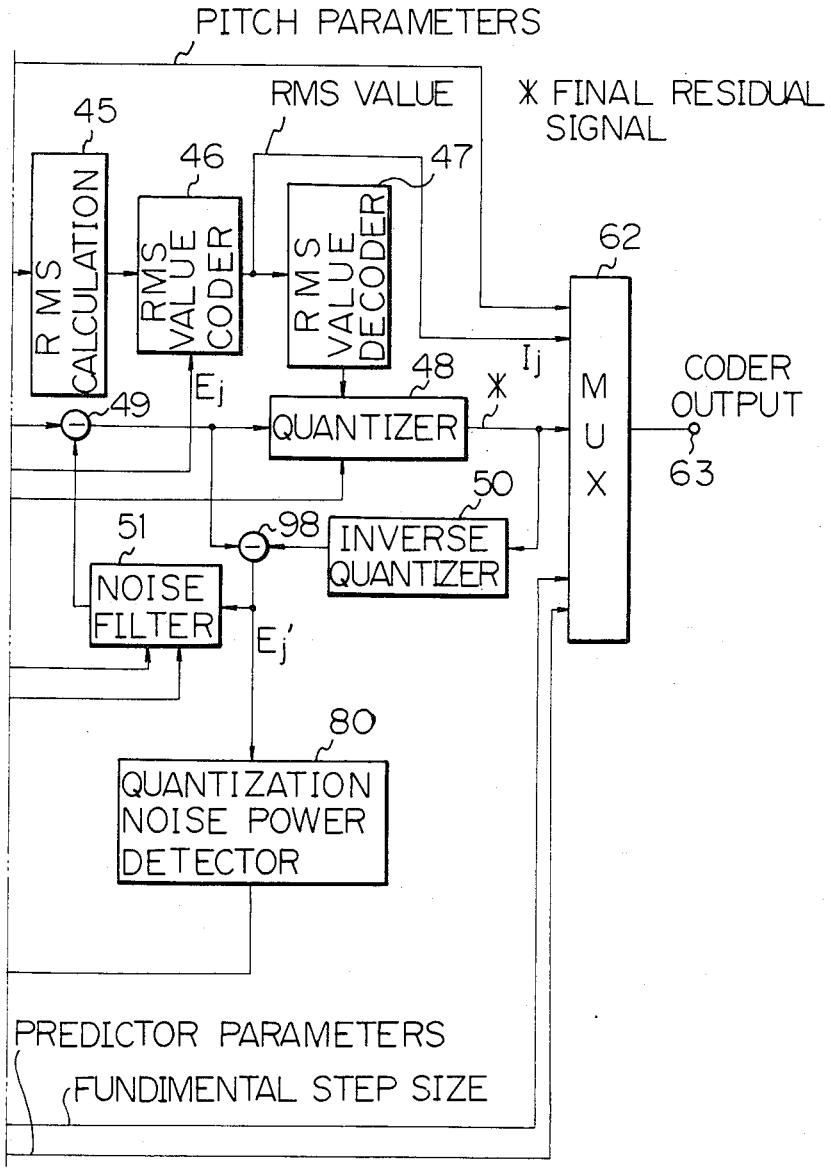

FIG. 4 is a block diagram of a coder according to the second embodiment, in which the input speech samples are processed according to the same stages as the stage (a)-(c) of the first embodiment. The feature of the present coding system exists in that there is provided a subtractor 98 and a quantization noise power detector 80 instead of the long-term predictor 55, the short-term predictor 56 and the minimum noise power detector 59 of FIG. 3A. Thus, the output of the subtractor 98 is input to the noise filter 51 and quantization noise power detector 80, whose output is input to the RMS value and shape size selection circuit 60. That is, the quantization noise power detector 80 calculates each quantization noise power with respect to all the combinations of each of all the fundamental step size and each of all the RMS values, and then detects the minimum quantization noise power among all the calculated quantization noise power. The following operation of the present coder is the same as the coder of FIG. 1. It will be apparent that the decoder with respect to the present coding system is the same structure as that of FIG. 3B.

The present speech coding system has the similar advantages as the speech coding system f FIG. 3A. However, speech quality in the reproduced speech signal somewhat deteriorates, because the quantized final residual signal is not locally decoded.

Through these applications, as the first predictor, the short-term predictor 38 is used and the long-term predictor 42 is used as the second predictor. As modifications of these applications, the long-term prediction may first be effected, and secondly the short-term prediction may be effected. That is, the location of the short-term predictor 38 and the long-term predictor 42 is interchanged to obtain the residual signal. In this case, the location of the long-term predictor 55 for local decoding and the short-term predictor 56 for local decoding is, of course, interchanged. Further, only the short-term predictor may be used to obtain the residual signal.

From the foregoing, ti will now be apparent that a new and improved speech coding system has been found. It should be understood of course that the embodiments disclosed are merely illustrative and are not intended to limit the scope of the invention. Reference should be made to the appended claims, therefore, rather than the specification as indicating the scope of the invention.

What is claimed is:

1. A speech coding system comprising:

prediction means for predicting a prediction value for an input speech signal and for providing a residual signal corresponding to a difference between said prediction value and said input speech signal;

quantizing means for quantizing a final residual signal based upon a selected quantization step size and for outputting a code final residual signal, said final residual signal being a difference between said residual signal and a spectrum-shaped quantization noise;

inversely quantizing means for inversely quantizing said coded final signal to obtain a reconstructed final residual signal;

a noise shaping means for extracting a quantization noise between said reconstructed final residual signal and said final residual signal, for shaping a spectrum of said quantization noise and for returning said spectrum-shaped quantization noise to an input of said quantizing means to obtain said final residual signal corresponding to a difference between said residual signal and said spectrum-shaped quantization noise;

quantization step size selecting means for selecting said quantization step size from a combination of a primary RMS value and several values close to said primary RMS value, and fundamental step sizes, so that an error power between said input speech signal and a locally decoded speech signal is minimized, said quantization step size selecting means including a locally decoding means including an inverse quantizer for inversely quantizing an output of said quantizing means, a predictor coupled with an output of said inverse quantizer for providing a reconstructed speech signal, an error power minimization means for providing an error power between said input speech signal and an output of said locally decoding means, and a step size selection means for selecting a step size which minimizes said error power; and a multiplexer for providing a coder output which includes at least an output of said quantizing means and an output of said quantizing step size adjusting means.

2. A speech coding system according to claim 1, wherein said prediction means comprises a short-term prediction means and a long-term prediction means, said short-term prediction means for predicting a first prediction value for a current sample of said input speech signal based on short-term correlation of said input speech signal and for calculating a first residual signal between said first prediction value and said current sample, said long-term prediction means for predicting a second prediction value for the current sample of said speech signal, for calculating a second residual signal between said second prediction value and said first residual signal, and for delivering said second residual signal as said residual signal.

3. A speech coding system according to claim 1, wherein said prediction means comprises a short term prediction means and a long-term prediction means, said short-term prediction means for predicting a first prediction value for a current sample of said input speech signal based on short-term correlation of said speech signal and for calculating a first residual signal between said prediction value and said current sample, said long-tern prediction means for predicting a second prediction value for the current sample of said first residual signal based on short-term correlation of said speech signal, for calculating a second residual signal between said second prediction value and said first residual signal, and for delivering said second residual signal as said residual signal.

4. A speech coding system according to claim 1, wherein said selected quantization step size is defined by a combination of a fundamental step size and a RMS value, said quantizing means having a plurality of quantization step sizes corresponding to respective properties of said input speech signal, said quantization step size selecting means further comprises RMS calculating means and a selecting means, said RMS calculating means for calculating a RMS value of said residual signal and a plurality of RMS values close to said calculated RMS value, said selecting means for selecting a combination of one of said fundamental step sizes and one of said RMS values, said final residual signal being quantized according to each quantization step size determined by each combination of all said fundamental step sizes and all said RMS values, and said quantization step size selecting means selecting said quantization step size by selecting one combination such that said error power is minimized by means of said selecting means.

5. A speech coding system according to claim 1, wherein said quantization step size selecting means selects the quantization step size at every subframe of said input speech signal.

6. A speech coding system according to claim 1, wherein said predictions means has predictor coefficients which are provided by analyzing the spectrum of said input speech signal, and which are weighted.

7. A speech coding system comprising:

prediction means for predicting a prediction value for an input speech signal and for providing a residual signal corresponding to a difference between said prediction value and said input speech signal;

quantizing means for quantizing a final residual signal based upon a selected quantization step size and for outputting a coded final residual signal, said final residual signal being a difference between said residual signal and a spectrum-shaped quantization noise;

inversely quantizing means for inversely quantizing said coded final residual signal to obtain a reconstructed final residual signal;

a noise shaping means for extracting a quantization noise between said reconstructed final residual signal and said final residual, for shaping a spectrum of said quantization noise and for returning said spectrum-shaped quantization noise to an input of said quantizing means to obtain said final residual signal corresponding to a difference between said residual signal and said spectrum-shaped quantization noise;

quantization step size selecting means for selecting said quantization step size from a combination of a primary RMS value and several values close to said primary RMS value, and fundamental step sizes, so that quantization noise power is minimized, said quantization step size selecting means including a quantization noise power minimization means for providing quantization noise power corresponding to a difference between said final residual signal and an output signal of said inversely quantizing means, a step size selection means for selecting a step size which minimizes said quantization noise; and a multiplexer for providing a coder output which includes at least the output of said quantizing means and a step size determined by said step size selection means.

* * * * *

UNITED STATES PATENT AND TRADEMARK OFFICE

CERTIFICATE OF CORRECTION

PATENT NO. : 4,811,396

DATED : March 7, 1989

INVENTOR(S) : YATSUZUKA

It is certified that error appears in the above-identified patent and that said Letters Patent is hereby corrected as shown below:

On the cover page, Item [30], line 2, "58-22385" should read --58-223856--.

Signed and Sealed this

Seventh Day of November, 1989

*Attest:*

JEFFREY M. SAMUELS

*Attesting Officer*

*Acting Commissioner of Patents and Trademarks*